US006558141B2

(12) United States Patent
Vonalt et al.

(10) Patent No.: US 6,558,141 B2
(45) Date of Patent: May 6, 2003

(54) PACKING ASSEMBLY AND RECIPROCATING PLUNGER PUMP INCORPORATING SAME

(75) Inventors: Kerry G. Vonalt, Edgerton, OH (US); Jonathan T. Wiechers, Defiance, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/833,277

(22) Filed: Apr. 12, 2001

(65) Prior Publication Data

US 2002/0150487 A1 Oct. 17, 2002

(51) Int. Cl.[7] ..... F04B 53/12
(52) U.S. Cl. ..... 417/554
(58) Field of Search ..... 91/249, 256, 257; 417/552, 554, 555.1

(56) References Cited

U.S. PATENT DOCUMENTS

| | | | | |
|---|---|---|---|---|
| 2,358,949 A | * | 9/1944 | Trautman | 417/552 |
| 2,673,103 A | | 3/1954 | Tremolada | |
| 3,019,739 A | | 2/1962 | Prosser | |
| 3,046,070 A | | 7/1962 | Gearhart | |
| 3,168,869 A | | 2/1965 | Sieghartner | |
| 3,372,648 A | | 3/1968 | Hammelmann | |
| 3,655,207 A | | 4/1972 | Schettler | |
| 3,698,726 A | | 10/1972 | Schettler | |
| 3,742,822 A | | 7/1973 | Talbert | |
| 3,776,558 A | | 12/1973 | Maurer et al. | |
| 3,787,149 A | * | 1/1974 | Dane et al. | 417/554 |
| 3,834,715 A | | 9/1974 | Butler | |
| 3,982,471 A | | 9/1976 | Finger | |
| 4,093,240 A | | 6/1978 | Masuda et al. | |
| 4,141,676 A | | 2/1979 | Jannen et al. | |
| 4,277,229 A | | 7/1981 | Pacht | |
| 4,306,728 A | | 12/1981 | Huperz et al. | |
| 4,364,542 A | | 12/1982 | Meyer | |
| 4,440,404 A | | 4/1984 | Roach et al. | |
| 4,470,607 A | | 9/1984 | Schier et al. | |
| 4,474,382 A | | 10/1984 | Hjelsand | |
| 4,495,855 A | | 1/1985 | Murakami et al. | |
| 4,512,586 A | | 4/1985 | Smith | |
| 4,568,249 A | | 2/1986 | Todd | |
| 4,572,519 A | | 2/1986 | Cameron et al. | |
| 4,602,791 A | | 7/1986 | Zollner | |
| 4,716,924 A | | 1/1988 | Pacht | |
| 4,875,690 A | | 10/1989 | Tojo | |
| 4,960,039 A | | 10/1990 | Robertson | |
| 5,040,608 A | | 8/1991 | Doan | |
| 5,111,736 A | | 5/1992 | Buchberger et al. | |
| 5,127,807 A | | 7/1992 | Eslinger | |
| 5,129,625 A | | 7/1992 | Wood et al. | |
| 5,230,498 A | | 7/1993 | Wood et al. | |
| 5,348,454 A | * | 9/1994 | Murphy | 417/554 |
| 5,398,944 A | | 3/1995 | D'Alfonso et al. | |
| 5,456,583 A | * | 10/1995 | Handzel | 417/454 |
| 5,577,737 A | | 11/1996 | Lacy | |
| 5,647,737 A | | 7/1997 | Gardner et al. | |
| 6,164,659 A | | 12/2000 | Netzer et al. | |

OTHER PUBLICATIONS

Falcon and Falcon II Pumps, Instructions–Parts List, No. 308996 Rev.A, Graco Inc., ©Copyright 1999, Graco Inc., 3 pages.

* cited by examiner

*Primary Examiner*—Michael Koczo
(74) *Attorney, Agent, or Firm*—Michael Best & Friedrich LLP

(57) ABSTRACT

A packing assembly for sealing a space between a pump plunger and a pump body of a reciprocating plunger pump with a plunger having a pumping end with an outer perimeter. At least one seal is disposed around the pumping end of the plunger and a securing member having a first end capable of attachment to the pumping end of the plunger. A second end having a flange with an outer perimeter greater than the outer perimeter of the pumping end of the plunger is also provided, such that when the first end of the securing member is attached to the pumping end of the plunger, the second end maintains the at least one seal disposed around the pumping end of the plunger.

20 Claims, 7 Drawing Sheets

PACKING ASSEMBLY AND RECIPROCATING PLUNGER PUMP INCORPORATING SAME

FIELD OF THE INVENTION

The present invention relates generally to packings for use in an annular packing space between a first cylindrical member which reciprocates within a cylindrical bore of a second member, and more particularly, but not by way of limitation, to such packing sets specifically designed for use in sealing the high pressure ends of a reciprocating plunger pump utilized for pumping fluids and slurries.

DESCRIPTION OF THE PRIOR ART

Reciprocating pumps and packing seals therefor are generally known with respective examples being shown in U.S. Pat. No. 5,647,737, the disclosure of which is incorporated herein by reference. These reciprocating pumps are operatively connected to a reciprocating drive means such as a piston type motor by a piston tube. The piston tube is directly connected to the base of the motor and encloses a reciprocating pump member which includes a number of seals.

Typically in high pressure reciprocating pumps, the seal between the reciprocating plunger and the cylinder comprises a packing arrangement including a plurality of V-shaped packing rings held in longitudinal compression with various male and female adapters at the forward and rearward ends of those packing sets. Generally, an upper packing arrangement and a lower packing arrangement is provided with the upper packing arrangement being stationary within the piston tube and the lower packing being located at and being movable with the end of the reciprocating plunger in the piston tube.

Very high pressures on the order of many thousands of pounds per square inch are typically involved in pumping operations involving these reciprocating pumps. Additionally, the fluids in the case of slurries are often very abrasive because they carry large quantities of solid particles therein. As a result, a very difficult sealing problem is encountered at the high pressure end across the lower packings of these pumps, where the fluid or slurry must be prevented from leaking between the reciprocating plunger and the cylinder within which it reciprocates. This leaking problem is further exacerbated by deterioration problems encountered in the use of such packings including the deterioration of the V-shaped packing rings due to the hydraulic load from the high pressure fluid end of the pump.

The foregoing illustrates limitations known to exist in present devices and methods. Thus, it is apparent that it would be advantageous to provide an alternative directed to overcoming one or more of the limitations set forth above. Accordingly, a suitable alternative is provided including the features more fully disclosed hereinafter.

SUMMARY OF THE INVENTION

In one aspect of the present invention, this is accomplished by providing a packing assembly for sealing a space between a pump plunger and a pump body of a reciprocating plunger pump with a plunger having a pumping end with an outer perimeter. At least one seal is disposed around the pumping end of the plunger and a securing member having a first end capable of attachment to the pumping end of the plunger. A second end having a flange with an outer perimeter greater than the outer perimeter of the pumping end of the plunger is also provided, such that when the first end of the securing member is attached to the pumping end of the plunger, the second end maintains the at least one seal disposed around the pumping end of the plunger.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION OF THE PREFERRED EMBODIMENT

Figure 1:
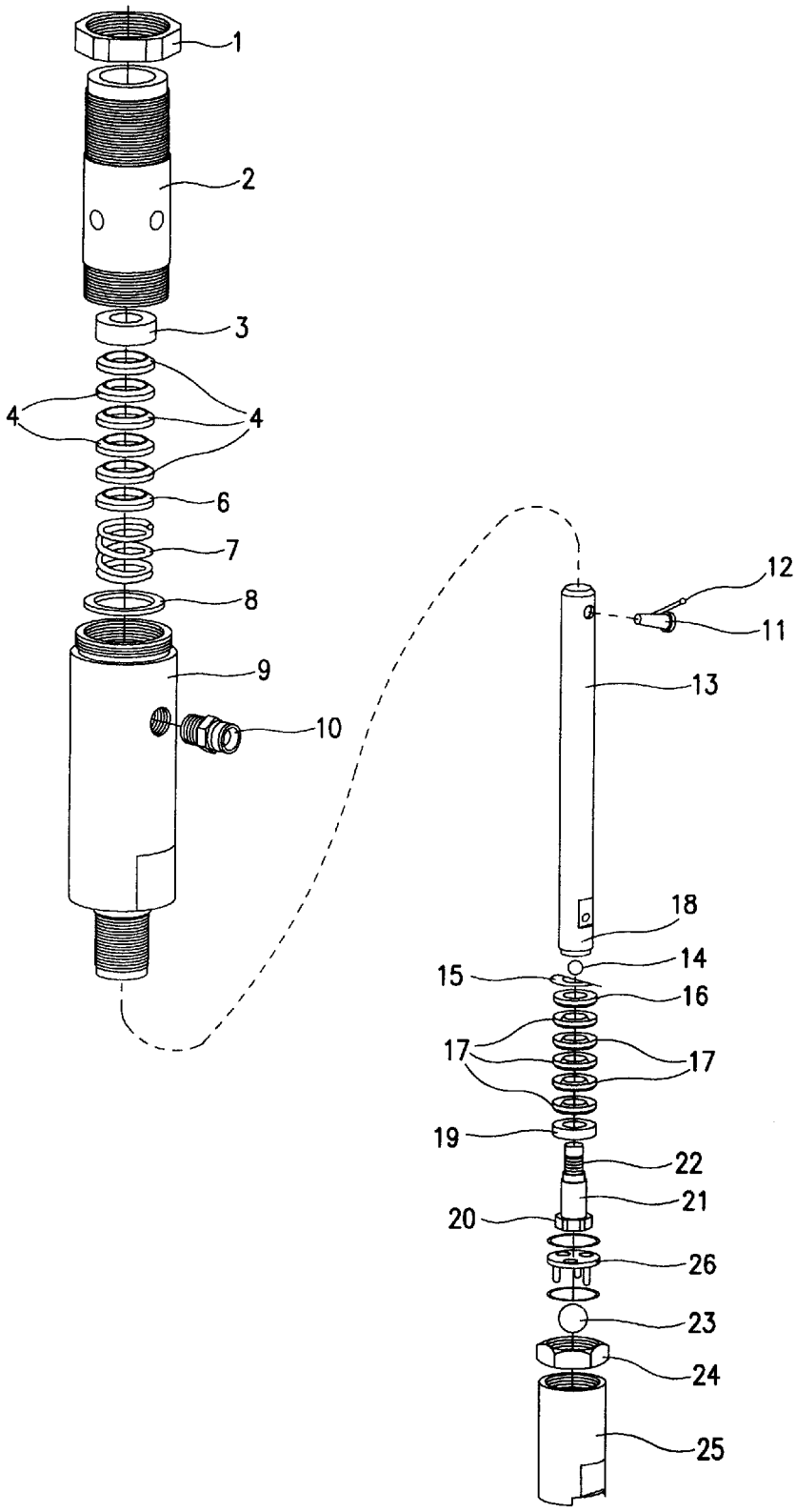
FIG. 1 PRIOR ART
FIG. 1 is an exploded view of a conventional reciprocating pump showing its component parts disassembled.

The invention is best understood by reference to the accompanying drawings in which like reference numbers refer to like parts. It is emphasized that, according to common practice, the various dimensions of the component pump parts as shown in the drawings are not to scale and have been enlarged for clarity.

Figure 2:
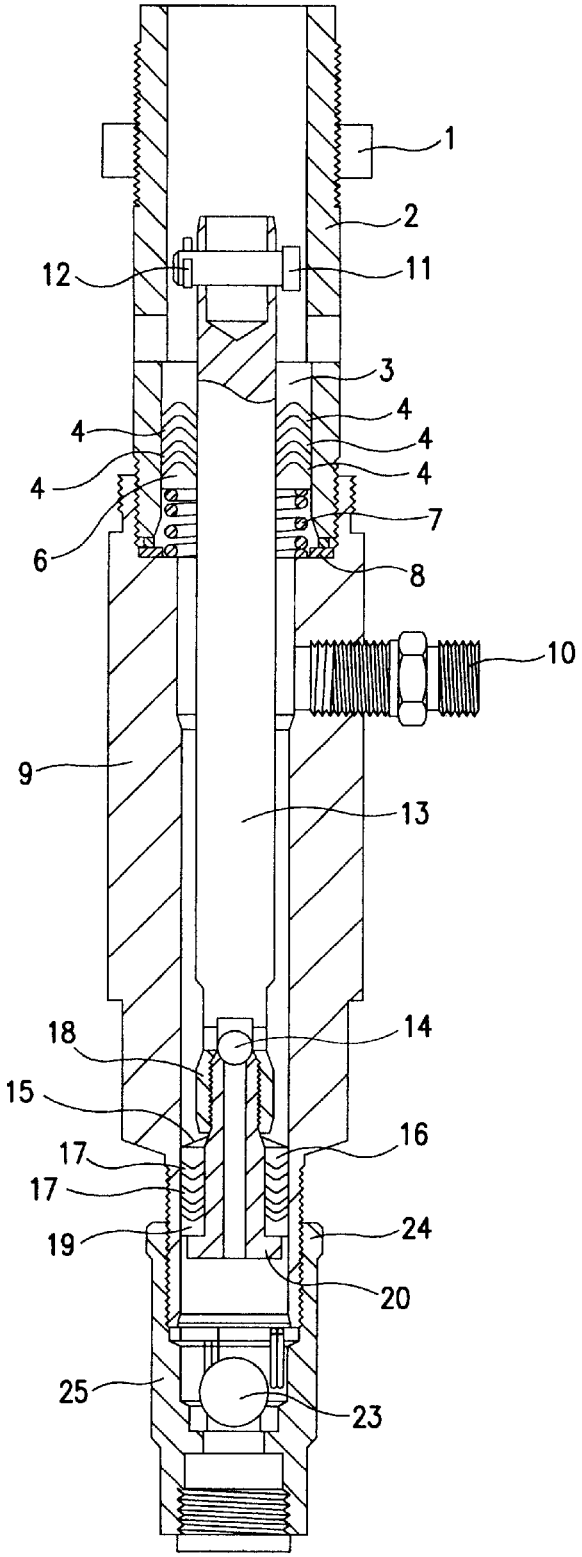
FIG. 2 PRIOR ART
FIG. 2 is a sectional view showing an assembled pump using the components shown in FIG. 1.

Referring now to the drawings, shown in FIG. 1 are a spacer tube 2, a cylindrical tube 9, and foot valve assembly 25 that when threaded together as shown in FIG. 2 define a cylindrical lower pump end of a conventional reciprocating piston pump. Spacer tube 2 attaches to a motor housing (not shown) using a locking nut 1 and contains an upper packing assembly comprising a plurality of "V"-rings or packings 4 held in longitudinal compression between a female washer 3 and a male washer 6 by a gasket 8 and a spring 7 as shown. Cylindrical tube 9 forms a pump outlet body and is provided with an outlet port 10 located between the ends of cylindrical tube 9. Foot valve assembly 25 is attached to the lower end of cylindrical tube 9 by a lock nut 24. A ball stop assembly 26 having a check ball 23 is sealed within foot valve assembly 25 as shown.

Disposed concentrically and longitudinally within spacer tube 2, cylindrical tube 9, and foot valve assembly 25 is a plunger 13 that on one upper end is attached to a drive rod of a motor (not shown) by a connecting pin 11 and cotter pin 12. The upper end of plunger 13 moves through the inner diameter of "V"-packings 4 which sealingly engage the plunger as it reciprocates within the cylindrical pump end.

Figure 3:
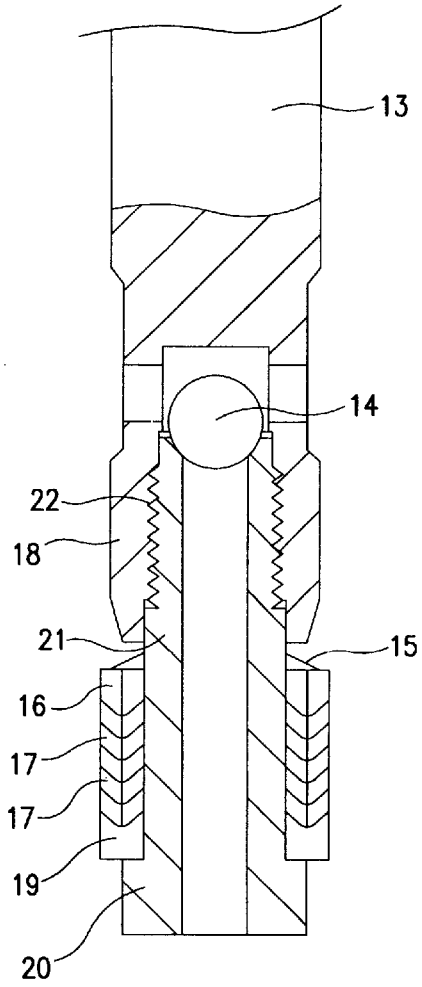
FIG. 3 PRIOR ART
FIG. 3 is an enlarged sectional view showing the lower pump end portion of the piston rod shown in FIG. 2.

Located within the lower end 18 of plunger 13 is a check ball 14 that seats within an inner valve seat 20 having a shaft portion 21 with threads 22 that engage threads in the lower end 18 of plunger 13 as shown. Located on the shaft portion 21 is a lower packing assembly comprising a plurality of "V"-rings or packings 17 held in longitudinal compression between a male packing washer 16 and a female packing washer 19 by a spring washer 15 and a flanged end of inner valve seat 20 as best shown in FIG. 3. During operation, the "V"-packings 17 of lower packing assembly reciprocate with plunger 13 and sealingly engage the lower end 18 of plunger 13 with the inner surface of the lower pump end as plunger 13 reciprocates therein.

Figure 4:
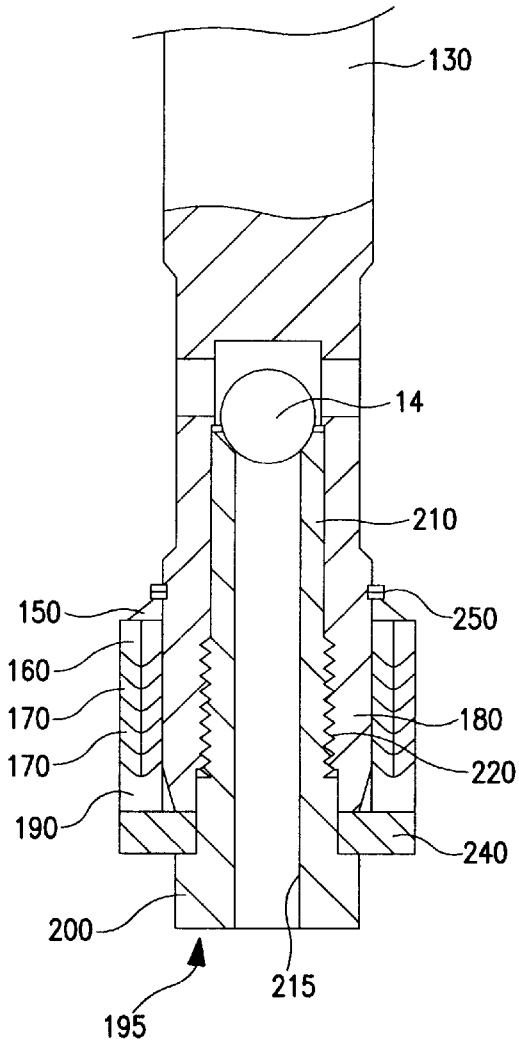
FIG. 4 is an enlarged sectional view showing a lower pump end portion of a piston rod and packing arrangement according to a preferred embodiment according to the present invention.

In order to improve the sealing ability and simplify the construction of packings for reciprocating piston pumps, an alternative sealing arrangement according to a preferred embodiment of the present invention is provided in FIG. 4 in which a lower packing assembly comprising a plurality of "V"-rings or packings 170 disposed on a lower end 180 of a plunger 130. According to a preferred embodiment of the present invention as best shown in FIG. 4, the lower packing assembly is held in longitudinal compression between a male packing washer 160 and a female packing washer 190 by a spring washer 150 and a washer 240 located concentrically on a flanged end of a securing member 195 that, preferably, has an inner valve seat 200. Preferably, a lock ring 250 disposed on plunger 130 is used to secure spring washer 150 as shown. Inner valve seat 200 is similar to inner valve seat 20 in that it comprises a shaft 210 having an internal passageway 215 and external threads 220 that engage threads in the lower end 180 of shaft 130. The overall position of the lower packing assembly with respect to the plunger 130 may be adjusted by shortening or lengthening both the lower end 180 of plunger 130 and the shaft 210.

During pump operation, the "V"-packings 170 of lower packing assembly move with plunger 130 and seal dynamically against the inner surface of the cylindrical lower pump end with the lower end 180 of plunger 130 as it reciprocates therein. By locating the lower set of packings on the same rod that passes through the upper set of packings, a sealing advantage is provided in that concentricity or alignment problems, caused when packings are located on a separate shaft (i.e., shaft 21 of inner valve seat 20 in FIG. 3) that is misaligned with the axis of the plunger, are reduced.

With respect to the materials selections of the component parts, "V"-packings of the upper and lower packing assemblies are preferably selected from leather, glass-filled PTFE, an ultra-high molecular weight polyethylene, other elastomeric sealing materials, or combinations thereof. The male and female packing washers are preferably brass and the gaskets are preferably nylon. The stress-bearing operating and structural parts are preferably various steels with the plunger, inner valve seat, check balls, and cylindrical tube forming the tube outlet body most preferably are hardened steels while carbon steels may be used for structural parts such as the foot valve assembly and the spacer tube, which parts are exposed to lesser stresses.

Figure 5:
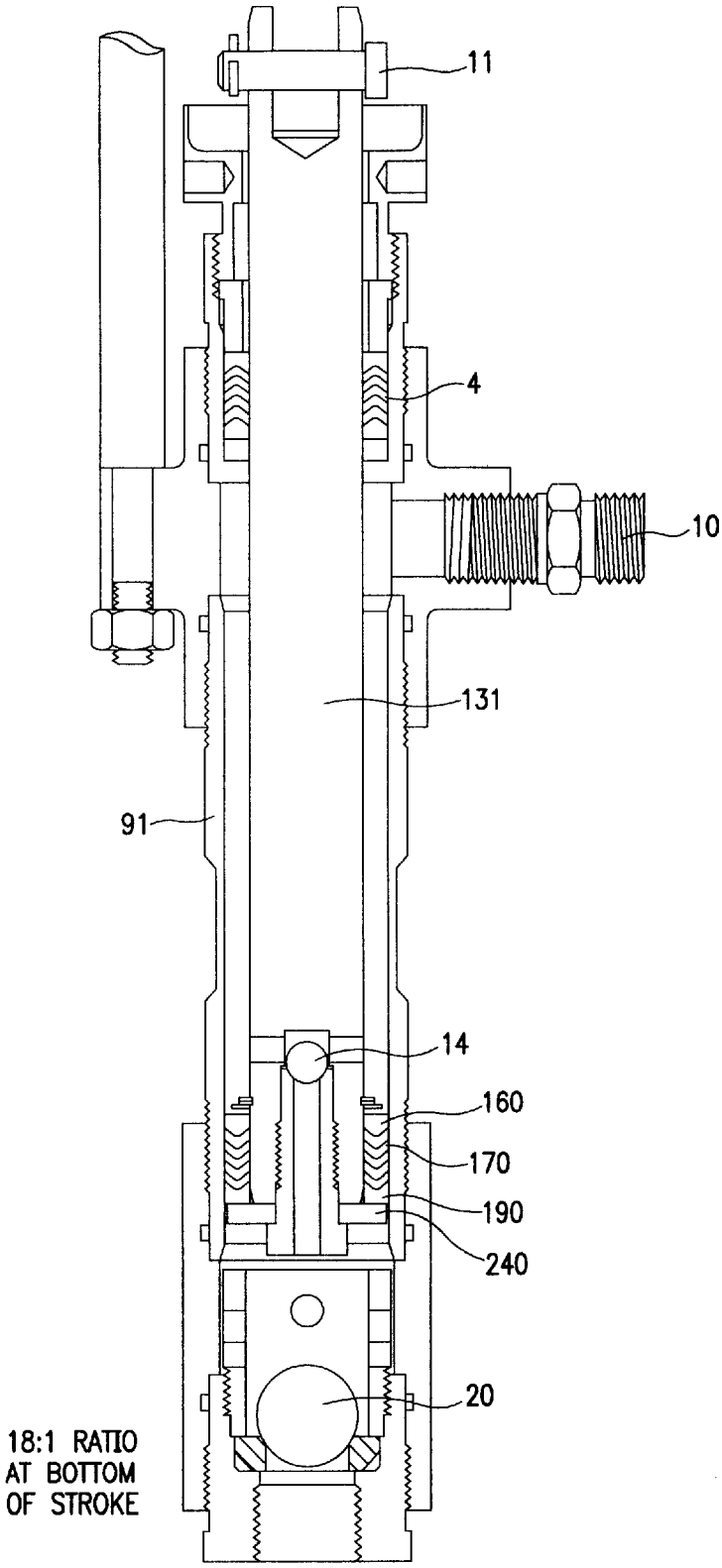
FIGS. 5–6 are sectional views showing sequential views of a pumping stroke in a reciprocating plunger pump according to a preferred embodiment according to the present invention.
Figure 6:
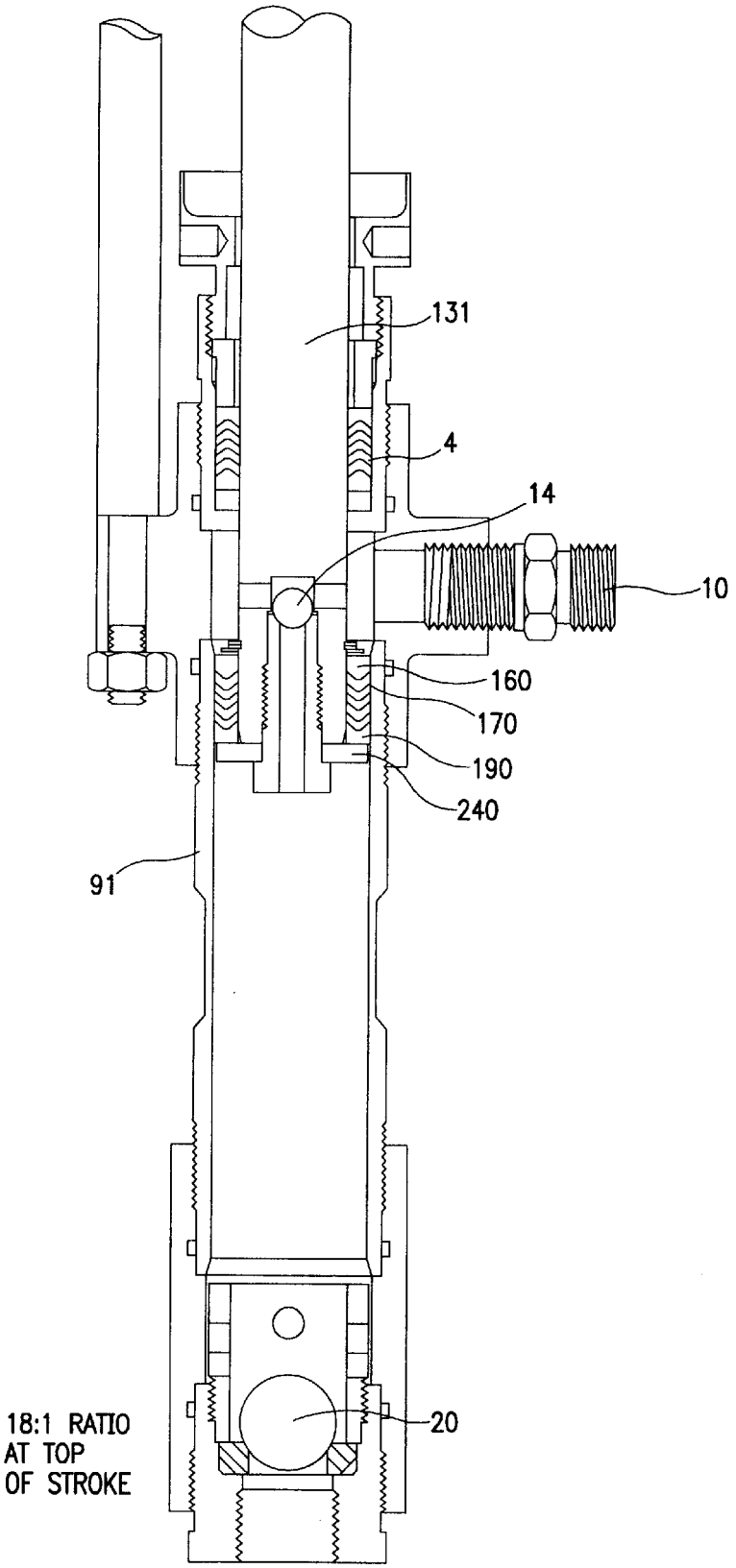
Figure 7:
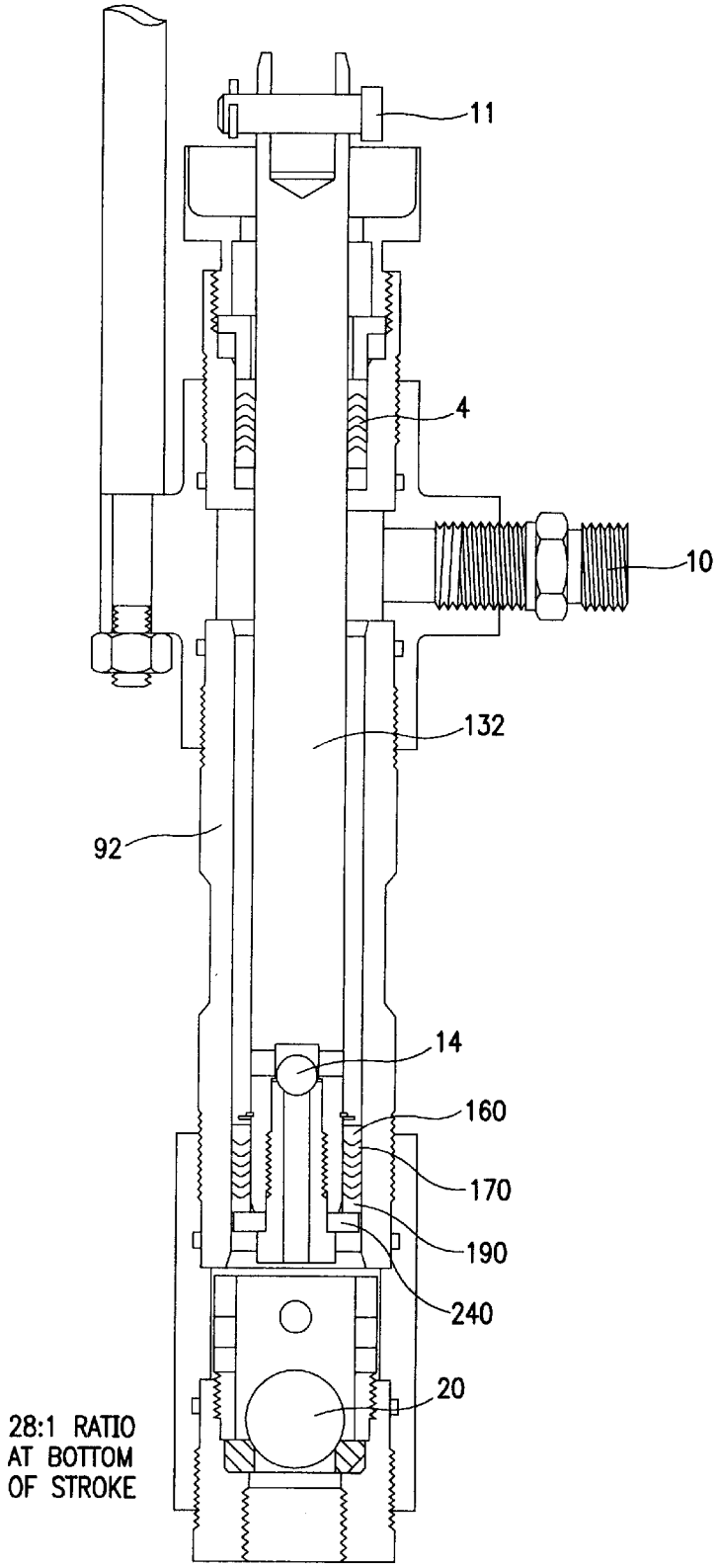
FIGS. 7–8 are sectional views showing sequential views of a pumping stroke in a reciprocating plunger pump according to a preferred embodiment according to the present invention.
Figure 8:
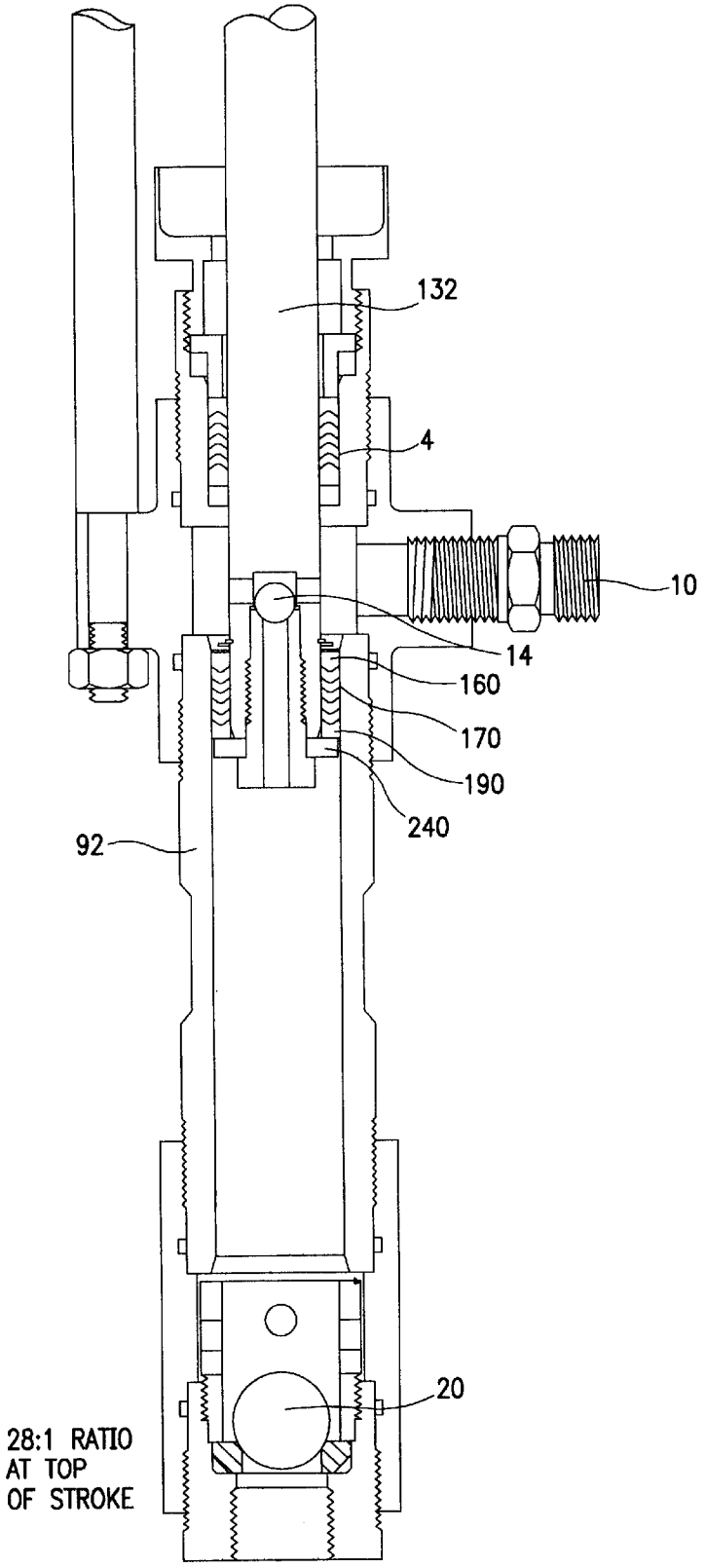

In other preferred embodiments of the present invention, shown in FIGS. 5–8 are cylindrical lower pump ends having plungers with lower packing assemblies with "V"-packings 170 that are the same diameter as "V"-packings 4 of the upper packing assemblies. With these configurations, the sealing advantage of the packing assemblies is further enhanced by reducing the number of sealing diameters along the plunger that could cause concentricity or alignment problems. The outlet to inlet pumping ratios of the pumps may also be varied by changing the ratio between the inner diameter of cylindrical tubes 91, 92 and plungers 131, 132 which are similar to cylindrical tube 9 and plunger 13, respectively, in that plungers 131,132 are disposed concentrically within cylindrical tubes 91,92. In FIGS. 5 and 6 an exemplary lower pump end arrangement is shown in sequential rod positions at both ends of a stroke with an 18:1 outlet/inlet pumping ratio being achieved using a plunger 131 having a 0.7071 inch outer diameter with a cylindrical tube 91 having a 1.000 inch inner diameter. In FIGS. 7 and 8 another exemplary lower pump end arrangement is shown in sequential rod positions at both ends of a stroke with an 28:1 outlet/inlet pumping ratio being achieved using a plunger 132 having a 0.5669 inch outer diameter with a cylindrical tube 92 having a 0.8017 inch inner diameter.

While embodiments and applications of this invention have been shown and described, it will be apparent to those skilled in the art that many more modifications are possible without departing from the inventive concepts herein described. For example, although the component parts are shown and described as having preferred dimensions and made using specific materials in certain preferred embodiments, it is envisioned that these selections may be modified. It is understood, therefore, that the invention is capable of modification and therefore is not to be limited to the precise details set forth. Rather, various modifications may be made in the details within the scope and range of equivalents of the claims without departing from the spirit of the invention.

What is claimed is:

1. A plunger for a reciprocating plunger pump, comprising:

a plunger having a constant maximum diameter along its length and a driven end and a pumping end with an outer perimeter, said driven end and said pumping end being provided concentrically and integrally on said plunger;

a first packing having at least one seal disposed around said driven end of said plunger;

a second packing having at least one seal disposed around said pumping end of said plunger; and a securing member comprising, a first end attached to said pumping end of said plunger; and a second end having a flange with an outer perimeter greater than said outer perimeter of said pumping end of said plunger;

wherein when said first end of said securing member is attached to said pumping end of said plunger, said second end maintains said at least one seal disposed around said pumping end of said plunger.

2. The packing assembly according to claim 1, wherein said first end of said securing member comprises an inner valve seat configured to seat against a check ball within said pumping end of said plunger.

3. The packing assembly according to claim 2, further comprising a shaft portion connecting said inner valve seat and said flange.

4. The packing assembly according to claim 3, wherein said shaft portion comprises an internal passageway passing through and interconnecting said first and second ends of said securing member.

5. The packing assembly according to claim 4 wherein said shaft portion is externally threaded and engages internal threads disposed on said pumping end of said plunger.

6. The packing assembly according to claim 1, further comprising a male packing washer and a female packing washer located around said pumping end with said at least one seal being disposed therebetween.

7. The packing assembly according to claim 6 wherein said at least one seal is in compression between said male and female packing washers.

8. The packing assembly according to claim 7 wherein said compression is caused by said flange upon attaching said first end of said securing member to said pumping end of said shaft.

9. The packing assembly according to claim 8, further comprising a lock ring disposed on said outer perimeter and spaced from said end of said plunger, said lock ring providing a stop against which said at least one seal is compressed.

10. The packing assembly according to claim 9, further comprising two washers disposed between said lock ring and said flange with said at least one seal being located between said washers.

11. The packing assembly according to claim 10 wherein said at least one of said two washers is a spring washer.

12. The packing assembly according to claim 1, wherein said plunger is cylindrical.

13. The packing assembly according to claim 1, wherein said at least one seal is a "V"-seal.

14. The packing assembly according to claim 1, wherein said at least one seal is a plurality of "V"-seals.

15. A reciprocating plunger pump, comprising:

a plunger having a constant maximum diameter along its length and a first driven end for attachment to a reciprocating power source and a second pumping end with an outer perimeter, said driven end and said pumping end being provided concentrically and integrally on said plunger;

a first packing having at least one seal disposed around said first driven end of said plunger;

a second packing having at least one seal disposed around said second pumping end of said plunger; and a securing member comprising, a first end attached to said second pumping end of said plunger; and a second end having a flange with an outer perimeter greater than said outer perimeter of said second pumping end of said plunger;

wherein when said first end of said securing member is attached to said second pumping end of said plunger, said second end maintains said at least one seal disposed around said second pumping end of said plunger.

16. The reciprocating plunger pump according to claim 15, wherein said plunger is cylindrical and has a constant diameter across its length.

17. The reciprocating plunger pump according to claim 15, wherein said at least one seal around said first driven end and said at least one seal around said second pumping end have the same dimensions.

18. The reciprocating plunger pump according to claim 15, wherein said at least one seal around said first driven end and said at least one seal around said second pumping end are "V"-seals.

19. The reciprocating plunger pump according to claim 15, wherein said at least one seal around said first driven end is a plurality of "V"-seals and said at least one seal around said second pumping end is a plurality of "V"-seals.

20. The reciprocating plunger pump according to claim 15, wherein said first end of said securing member comprises an inner valve seat configured to seat against a check ball within said second pumping end of said plunger.

* * * * *